US006827588B1

(12) United States Patent
Huang et al.

(10) Patent No.: US 6,827,588 B1
(45) Date of Patent: Dec. 7, 2004

(54) LOW PROFILE BOARD-TO-BOARD CONNECTOR ASSEMBLY

(75) Inventors: Eric Huang, Tucheng (TW); Richard Peng, Tucheng (TW); Emma Chiang, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 4 days.

(21) Appl. No.: 10/459,503

(22) Filed: Jun. 12, 2003

(51) Int. Cl.[7] ..... H01R 12/00
(52) U.S. Cl. ..... 439/74
(58) Field of Search ..... 439/74, 660

(56) References Cited

U.S. PATENT DOCUMENTS 5,161,985 A * 11/1992 Ramsey ..... 439/74
5,520,545 A * 5/1996 Sipe ..... 439/65
5,599,192 A * 2/1997 Olson ..... 439/65
5,626,482 A * 5/1997 Chan et al. ..... 439/74
5,626,500 A * 5/1997 Yoshimura ..... 439/862
5,639,248 A * 6/1997 Yagi ..... 439/74
5,830,018 A * 11/1998 Simmel ..... 439/660
5,836,773 A * 11/1998 McHugh et al. ..... 439/74
5,842,875 A * 12/1998 Yagi ..... 439/74
5,888,076 A * 3/1999 Itoh et al. ..... 439/74
5,931,689 A * 8/1999 Patel ..... 439/346
5,975,916 A * 11/1999 Okura ..... 439/74
6,135,785 A * 10/2000 Niitsu ..... 439/74
6,390,828 B1 * 5/2002 Yamaguchi et al. ..... 439/74
6,464,515 B1 * 10/2002 Wu ..... 439/108

* cited by examiner

*Primary Examiner*—Gary Paumen
(74) *Attorney, Agent, or Firm*—Rosenberg, Klein & Lee

(57) ABSTRACT

A low profile board-to-board connector assembly includes a receptacle and a detachable plug. The receptacle has a receptacle housing with a plurality of arrayed first contacts mounted therein. Each first contact has a base portion, a first solder tail portion extending outwardly from one end of the base portion for connection with a first PCB, a retention portion perpendicular to the base portion, and a free first spring contact portion bent from the other end of the base portion and extending parallel to the retention portion. The plug has a plug housing with a plurality of arrayed second contacts mounted therein. Each second contact has a U-shaped portion with a pair of legs one of which is a free second spring contact portion and the other of which is a locking portion, and a second solder tail potion bent from an end of the locking portion and extending outwardly for connection with a second PCB. When the receptacle and the plug are assembled, the first spring contact portion can engage at its free end with the free end of the second contact portion thereby providing sufficient spring bias for reliable electrical contact with each other.

12 Claims, 6 Drawing Sheets

LOW PROFILE BOARD-TO-BOARD CONNECTOR ASSEMBLY

BACKGROUND OF THE INVENTION

1. Field of the Invention

The present invention generally relates to a low profile board-to-board connector assembly, and more particularly to a connector assembly having a receptacle and a plug which is capable of assuring a reliable electrical contact therebetween.

2. The Related Art

The trend of the electronic industry is to constantly reduce the size of electronic devices. Board-to-board connectors to electrically connect parallel printed circuit boards in the electronic devices are correspondingly required tinier and tinier. Moreover, contacts of the connectors are arranged thicker and thicker. These changes make high precision requirements of the connectors, and it is desirable to assure the reliable electrical contact between contacts of the receptacle and the plug.

U.S. Pat. Nos. 5,931,689, 5,842,875, 5,836,773, 5,830,018, 5,639,248, 5,626,500, 5,626,482, 5,599,192 and 5,161,985 disclose a traditional board-to-board connector assembly composed of a receptacle with a plurality of first contacts and a plug with a plurality of second contacts. Each of the first contacts has a S-shaped or U-shaped portion to provide a first spring contact end at its free end. While, each of the second contacts is shaped to have a straight contact end for pressed contact with the first spring contact end. The normal force to achieve the pressed contact only comes from a resilient deformation of the first spring contact end. In order to maintain a reliable contact between the contacts, it is necessary to make the S-shaped or U-shaped portion develop a considerably large spring bias. In this consequence, however, it becomes difficult to insert or remove the plug into and from the receptacle. Otherwise, poor electrical contact would result. Further, the straight contact end of the second contact is required to be held to a plug housing over a long length so as to be firmly fixed thereto, thereby an extra height is added to the plug and the assembly, which hinders the assembly from achieving a low profile design.

U.S. Pat. No. 5,520,545 discloses another traditional board-to-board connector assembly. First and second contacts of the assembly each have a U-shaped spring portion. The first and the second U-shaped spring portions are oriented in opposite directions in the assembled condition. However, such configuration cannot permit to give a contact point at the interface between the free ends of the spring contact ends. With this result, substantially only one of the U-shaped portions is best utilized to give a spring bias for providing a contact pressure between the first and the second spring contacts. Therefore, adequate contact pressure for reliable electrical connection between the first and the second contacts still cannot be achieved. If the contact area of the first and the second contacts is increased to solve above problem, it is also a hindrance to minimize the assembly.

U.S. Pat. No. 5,975,916 discloses another traditional board-to-board connector assembly. Each of first contacts of the assembly has a S-shaped portion composed of inverted and upright U-shaped portions. Each of second contacts of the assembly has a U-shaped portion. In the assembled condition, upright U-shaped portion of the first contact and U-shaped portion of the second contact are oriented in the same direction. With this structure, however, stress tends to concentrate on a bottom of the upright U-shaped portion where has a risk of occurring fatigue, and reliable electrical contact within the assembly cannot be assured.

SUMMARY OF THE INVENTION

An object of the present invention is to provide a low profile board-to-board connector assembly which is designed so as to provide a sufficient contacting pressure for reliable electrical contact within the assembly.

The low profile board-to-board connector assembly in accordance with the present invention comprises a receptacle and a detachable plug. The receptacle has a receptacle housing with a plurality of arrayed first contacts mounted therein. Each first contact has a base portion, a first solder tail portion extending outwardly from one end of the base portion for connection with a first printed circuit board (PCB), a retention portion perpendicular to the base portion, and a free first spring contact portion bent from the other end of the base portion and extending parallel to the retention portion. The plug has a plug housing with a plurality of arrayed second contacts mounted therein. Each second contact has a U-shaped portion with a pair of legs one of which is a free second spring contact portion and the other of which is a locking portion, and a second solder tail potion bent from an end of the locking portion and extending outwardly for connection with a second PCB. When the receptacle and the plug are assembled, the first spring contact portion can engage at its free end with the free end of the second spring contact portion thereby providing sufficient spring bias for reliable electrical contact with each other.

BRIEF DESCRIPTION OF THE DRAWING

The present invention will be apparent to those skilled in the art by reading the following description of embodiments thereof, with reference to the attached drawing, in which.

DETAILED DESCRIPTION OF THE PREFERRED EMBODIMENT

Figure 1:
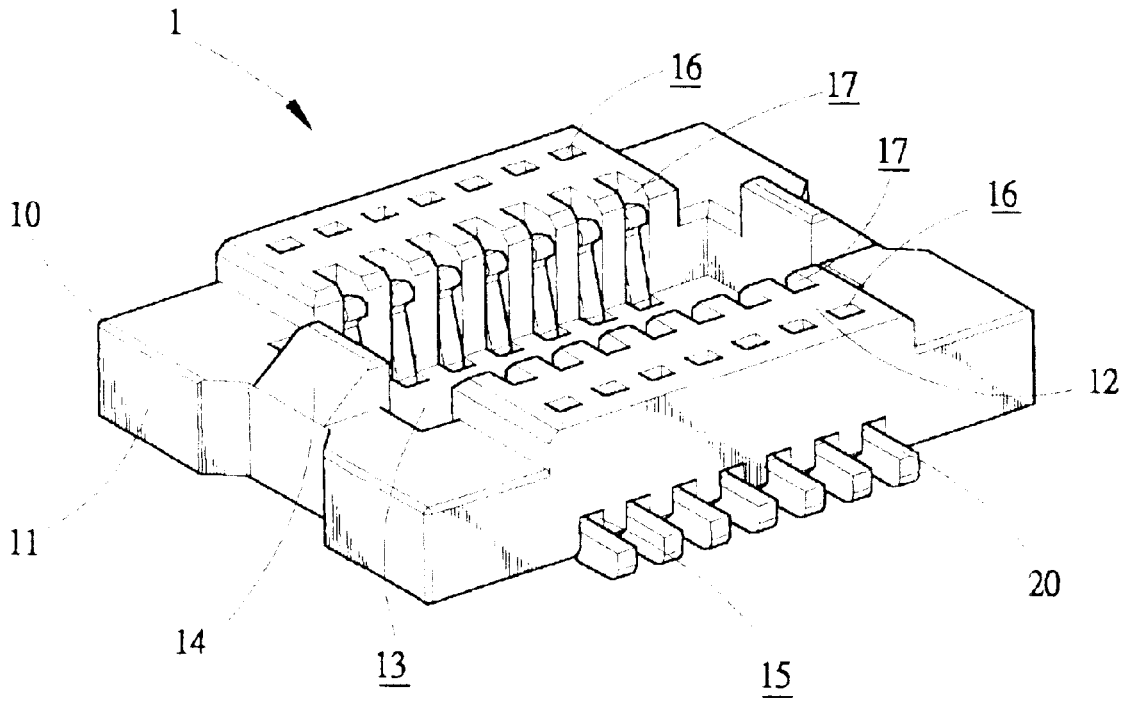
FIG. 1 is a perspective view of a receptacle utilized in a low profile board-to-board connector assembly in accordance with a preferred embodiment of the present invention.
Figure 2:
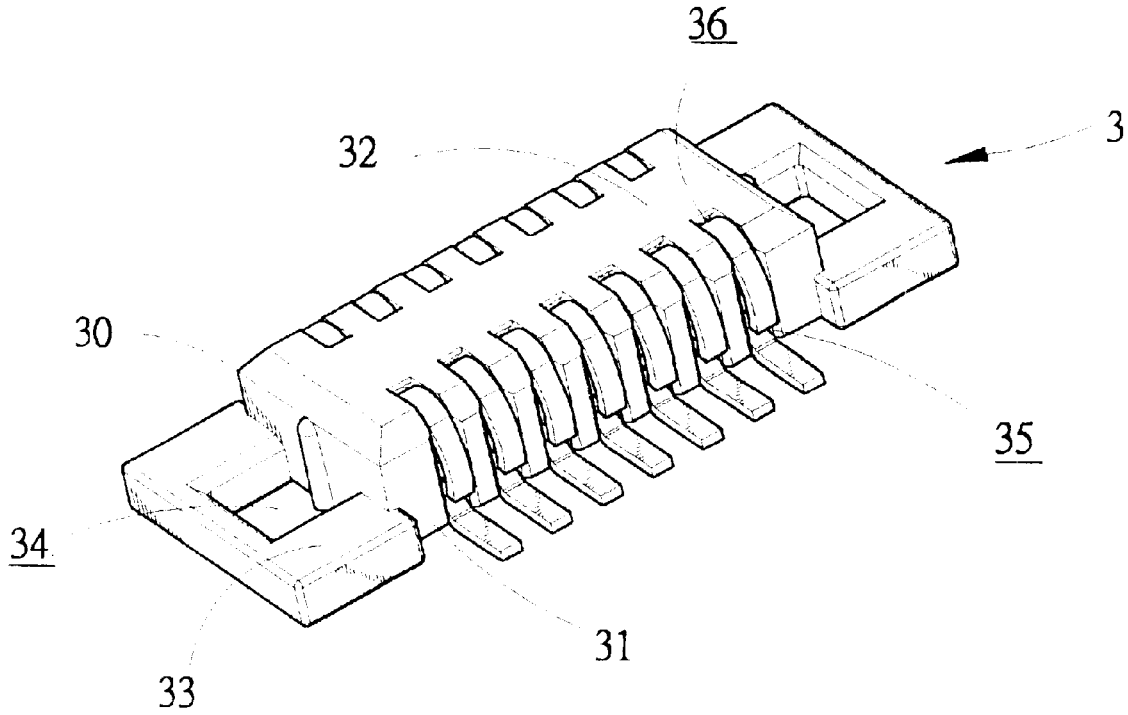
FIG. 2 is a perspective view of a plug utilized in the low profile board-to-board connector assembly in accordance with the present invention.

Referring now to FIGS. 1 and 2, a low profile board-to-board connector assembly in accordance with a preferred embodiment of the present invention is shown. The connector assembly is composed of a receptacle 1 and a plug 3 which are respectively of flat configurations for surface mounting on individual printed circuit boards (PCBs) (not shown) to interconnect circuits on the boards.

Figure 3:
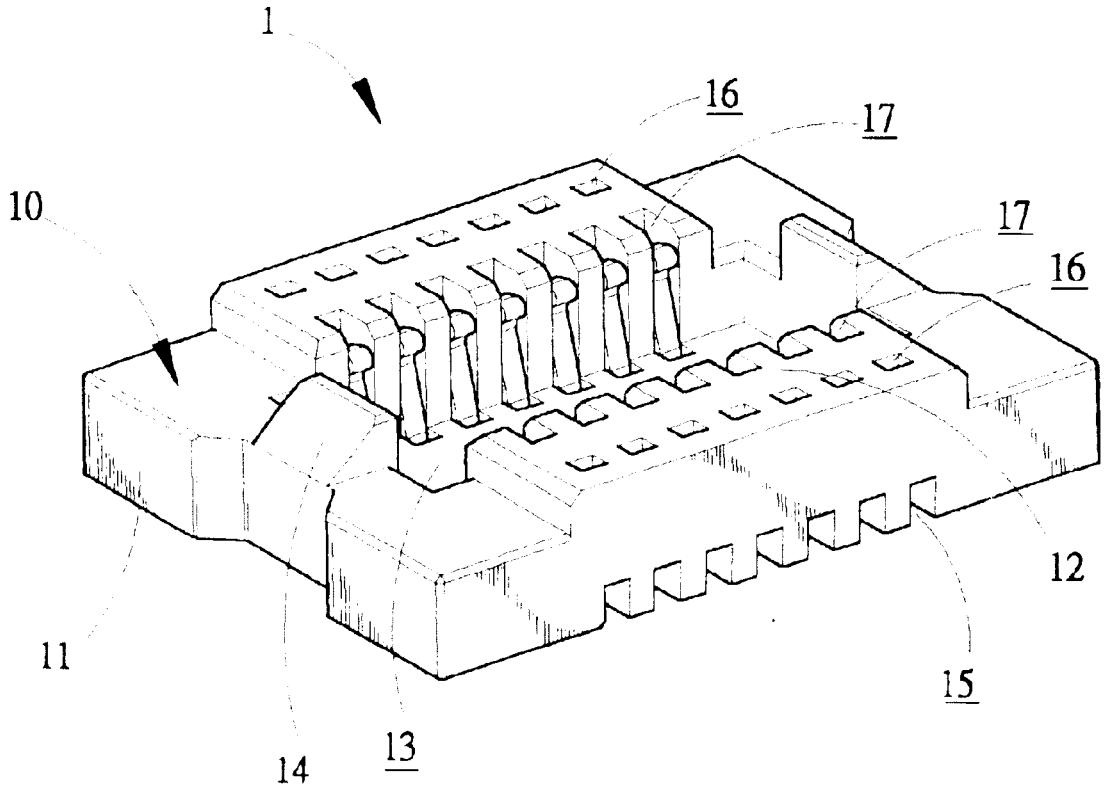
FIG. 3 is an exploded perspective view of the receptacle.
Figure 3:
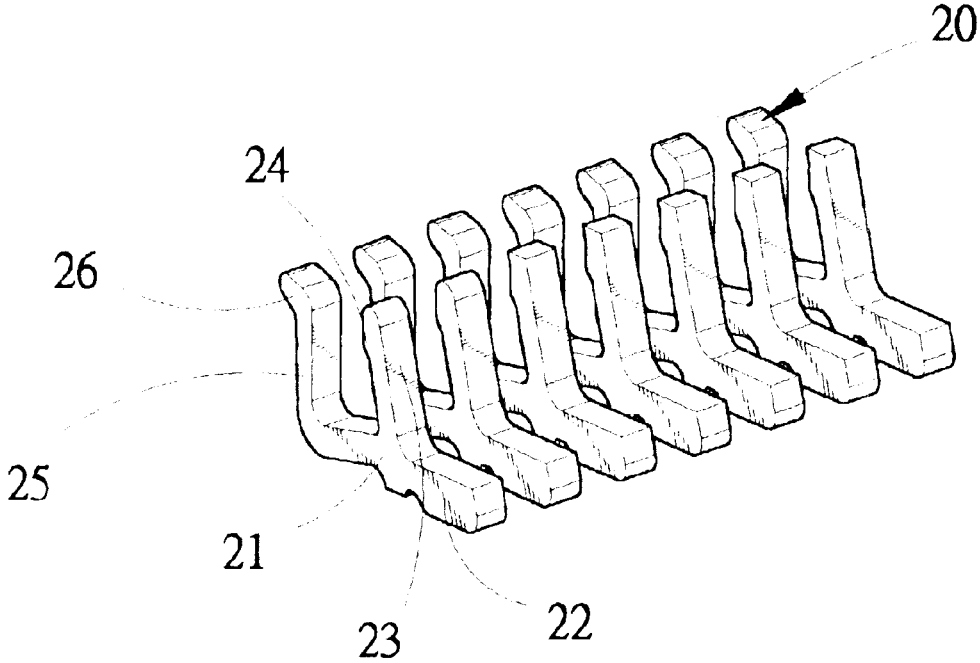

As shown in FIGS. 1 and 3, the receptacle 1 comprises a receptacle housing 10 mounting a plurality of first contacts 20 in two parallel arrays. The receptacle housing 10 is of a flat rectangular configuration to have a flat base 11. Side walls 12 are projected on opposite lateral sides of the base 11. The side walls 12 extend along the length of the base 11 to define a recess 13 therebetween. A pair of wedgy protrusions 14 extends upwardly from opposite ends of the base 11. A bottom of each side wall 12 forms a plurality of evenly spaced first slots 15 which extend through the base 11 for holding the first contacts 20 respectively. Each side wall 12 further forms a plurality pair of vertical mounting holes 16 and vertical receiving holes 17 extending therethrough and communicating with corresponding first slots 15. The receiving holes 17 also communicate with the recess 13. As the two arrays of the first contacts 20 are symmetrically configurated, only one array of the first contacts 20 is disassembled from the receptacle 1 in FIG. 3 for illustration. As each first contact 20 has the same configuration, only one first contact 20 is illustrated for the following detail description. With the same reason, only one array of second contacts 40 is disassembled from the plug in FIG. 4 for illustration.

Figure 5:
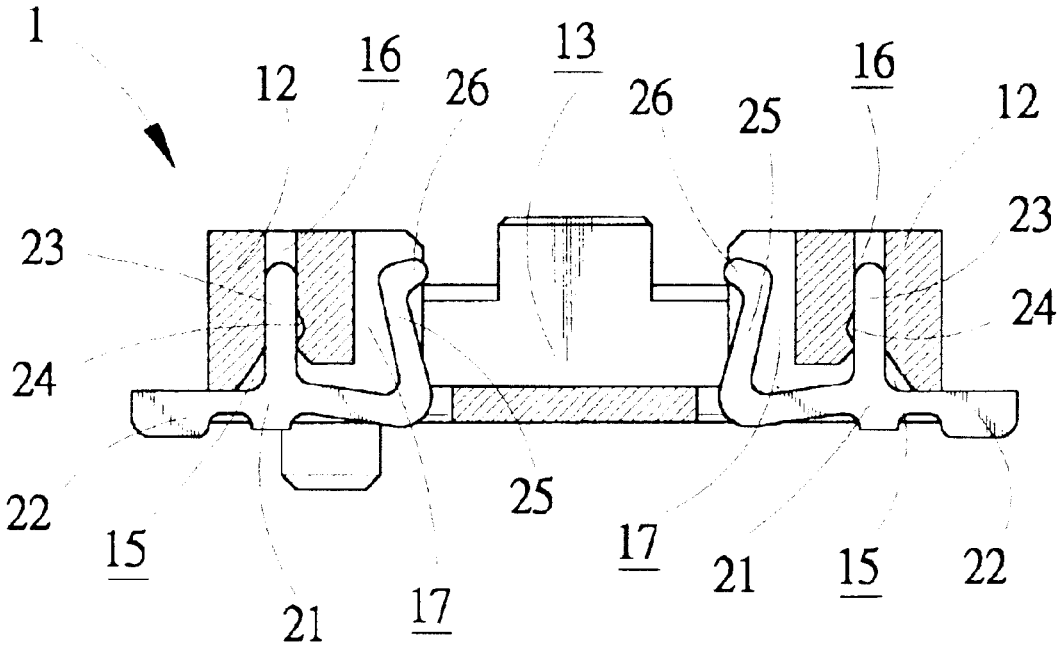
FIG. 5 is a sectional view of the receptacle.

The first contact 20 is stamped of sheet metal material. The first contact 20 has a rigid base portion 21, a first solder tail portion 22 extending from one end of the base portion 21, a retention portion 23 perpendicular to the base portion 21 and extending from a common boundary of the base portion 21 and the first solder tail portion 22, and a first spring contact portion 25 bent from the other end of the base portion 21 and extending parallel to the retention portion 23. The retention portion 23 is provided with a pair of barbs 24 on opposite edges of the retention portion 23. A free end of the first spring contact portion 25 is inclined outwardly to define a contact end 26. Referring to FIGS. 1, 3 and 5, especially to FIG. 5, the first contact 20 is inserted into the corresponding first slot 15 from a bottom of the base 11. Simultaneously, the retention portion 23 comes into the mounting hole 16, and the first spring contact portion 25 is received in the receiving hole 17. The barbs 24 of the retention portion 23 are pressed abutment against an inner wall of the mounting hole 16. The first contact 20 is thus secured in the receptacle housing 10, then, the first solder tail portion 22 horizontally extends from the bottom of the receptacle housing 10 for soldering connection on a printed circuit board (not shown) and the contact end 26 projects into the recess 13, thereby allowing the contact end 26 to flex toward the receiving hole 17.

Figure 4:
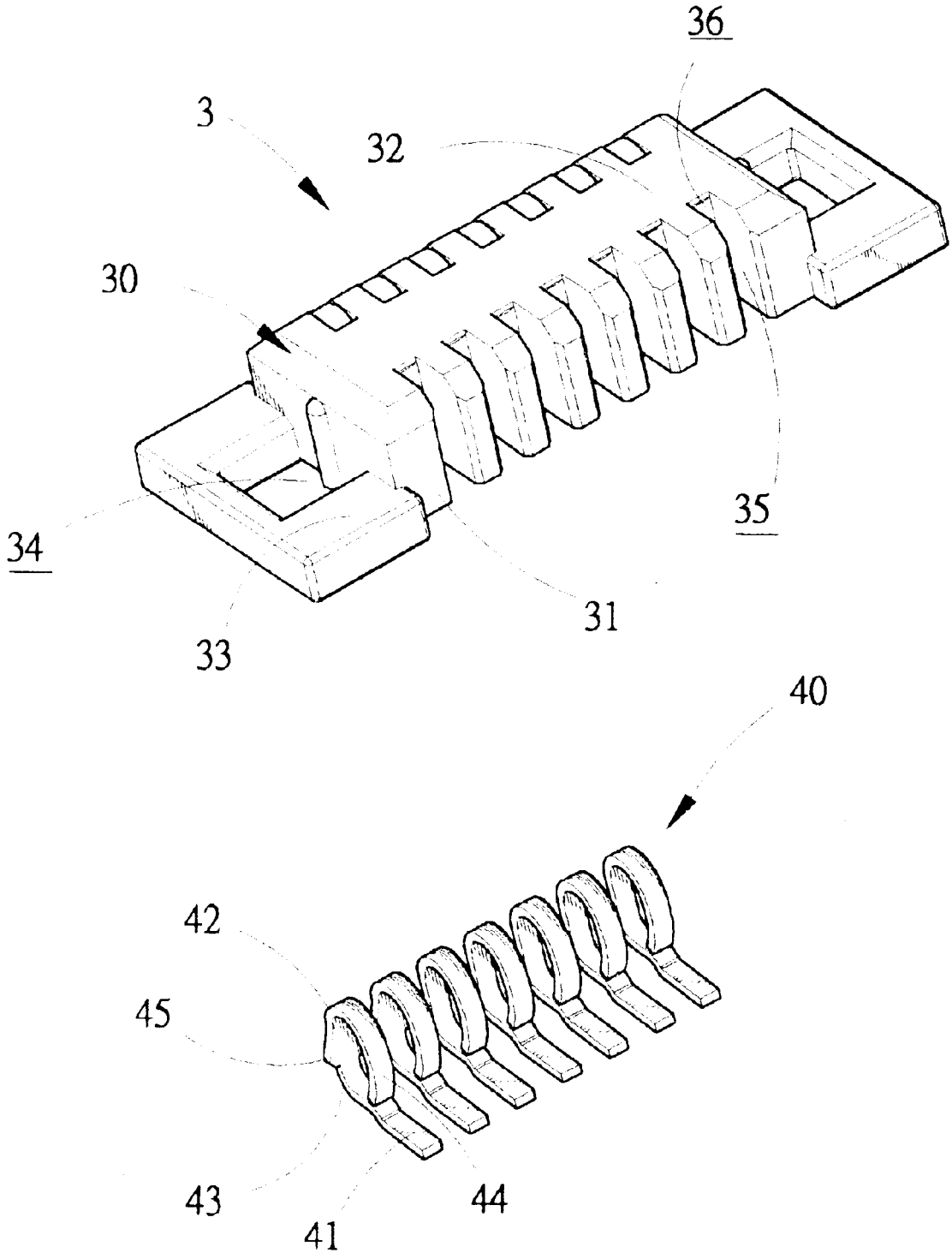
FIG. 4 is an exploded perspective view of the plug.

With reference to FIGS. 2 and 4, the plug 3 comprises a plug housing 30 mounting a plurality of second contacts 40 in two parallel arrays. The plug housing 30 has a flat bottom 31 and an elongated tenon 32 projecting from the bottom 31 for mating engagement into the recess 13 of the receptacle housing 10. The plug housing 30 further includes a pair of ears 33 extending outwardly from opposite ends of the bottom 31. Each ear 33 forms a notch 34 for engaging with corresponding protrusion 14 to interconnect the receptacle 1 and the plug 3. The tenon 32 is formed in its laterally opposite sides respectively with evenly spaced second slots 35. The second slots 35 extend through the tenon 32 and the bottom 31. An outer side of each second slot 35 communicates with outside, while an inner side of each second slot 35 defines a broader interference groove 36.

The second contact 40 is a stamped and formed metal strip which is shaped to have a U-shaped portion 42 with a pair of legs one of which is defines a second spring contact portion 44 and the other of which defines a locking portion 43 for fixed engagement with the tenon 32. A second solder tail portion 41 is bent from the lower end of the locking portion 43 and extends horizontally over the lower end of the second spring contact portion 44. The locking portion 43 is provided with a pair of tabs 45 on opposite edges of the locking portion 43. Together with reference to FIG. 6, the second contact 40 is pressed in the corresponding second slot 35 from the bottom 31 with the locking portion 43 fitted in the interference groove 36 Simultaneously. The tabs 45 of the locking portion 43 are for pressed abutment against inner walls of the interference groove 36. The second contact 40 is thus secured in the plug housing 30, then, the second solder tail portion 41 horizontally extends from the bottom 31 for soldering connection on a printed circuit board (not shown) and the second spring contact portion 44 exposes to the exterior of the tenon 32, thereby allowing the second spring contact portion 44 to flex toward the second slot 35.

Figure 6:
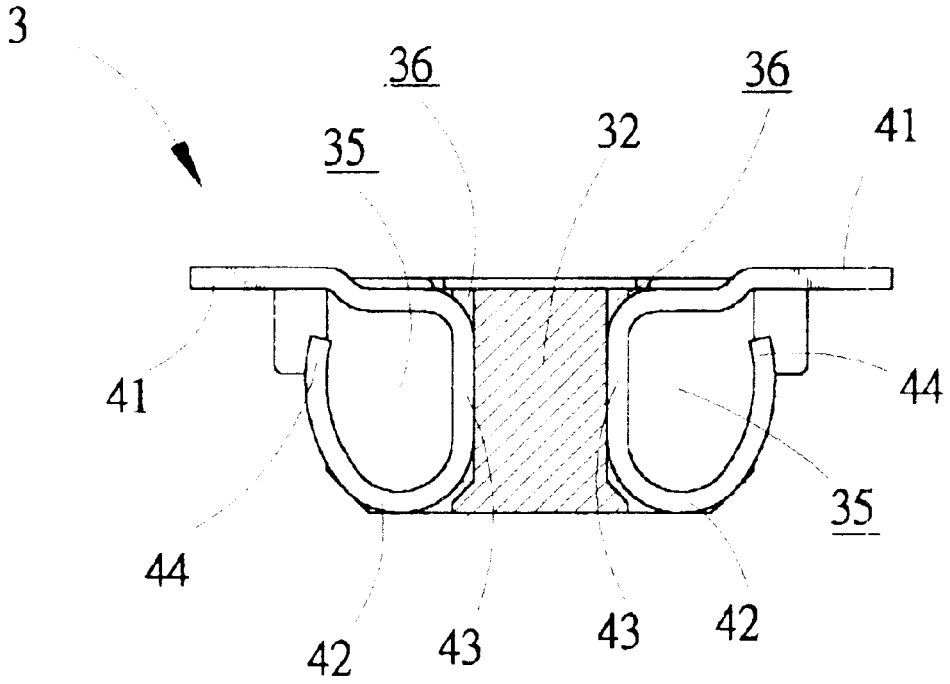
FIG. 6 is a sectional view of the plug.
Figure 7:
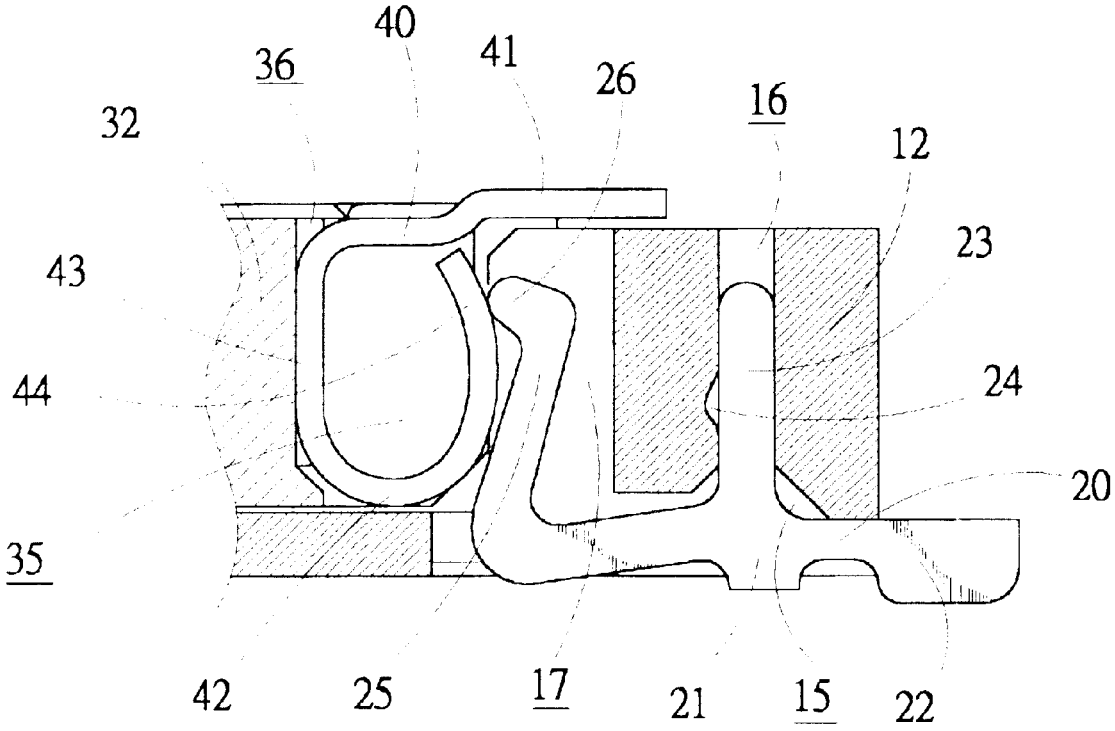
FIG. 7 is a sectional view of the low profile board-to-board connector assembly in a connected condition.

Further referring to FIGS. 5–7, when inserting the tenon 32 of the plug 3 into the recess 13 of the receptacle 1 and the engaging the protrusion 14 of the receptacle 1 with the notch 34 of the plug 3, the first and the second spring contact portions 25 and 44 are both caused to flex inwardly so as to correspondingly develop individual spring biases which are cooperative to give a sufficient contact pressure at a contact point between the first and the second spring contact portions 25 and 44. Thus, the first and the second contacts 20 and 40 are kept electrically connected stably and reliably at such sufficient contacting pressure. Moreover, the structure of the first contact 20 can improve the distribution of the stress to avoid fatigue. In addition, the second spring contact portion 44 can further form a dent (not shown) at the lower end thereof for serving as a second contact end for catching the contact end 26 of the first contact 20 to provide a latching engagement therebetween to reinforce the interconnection of the receptacle 1 and the plug 3.

While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

What is claimed is:

1. A low profile board-to-board connector assembly, comprising:

a receptacle having a receptacle housing with a plurality of arrayed first contacts mounted therein, each first contact having a base portion, a first solder tail portion extending outwardly from one end of the base portion for connection with a first printed circuit board, a retention portion perpendicular to the base portion and extending from a common boundary of the base portion and the first solder tail portion, and a first spring contact portion bent from the other end of the base portion and extending parallel to the retention portion; and a plug having a plug housing with a plurality of arrayed second contacts mounted therein, each second contact having a U-shaped portion with a pair of legs one of which is defines a second spring contact portion and the other of which defines a locking portion for securing the second contact in the plug housing, and a second solder tail potion bent from an end of the locking portion and extending outwardly for connection with a second printed circuit board;

wherein each of the first spring contact portion is engaged with a corresponding second spring contact portion when the receptacle and the plug are in assembled condition.

2. The low profile board-to-board connector assembly as claimed in claim 1, wherein the receptacle housing has a flat base and side walls projecting on opposite lateral sides of the base, and a recess is defined between the side walls.

3. The low profile board-to-board connector assembly as claimed in claim 2, wherein the plug housing has a flat bottom and an elongated tenon projecting from the bottom for mating engagement into the recess of the receptacle housing.

4. The low profile board-to-board connector assembly as claimed in claim 3, wherein a bottom of each of the side walls forms a plurality of evenly spaced first slots which extend through the base for holding the first contacts respectively.

5. The low profile board-to-board connector assembly as claimed in claim 4, wherein each of the side walls further forms a plurality pair of vertical mounting holes and vertical receiving holes extending therethrough and communicating with corresponding first slots, and the receiving holes 17 also communicate with the recess, said retention portion is fitted in the mounting hole, said second spring contact portion is received in the receiving hole and projects into the recess.

6. The low profile board-to-board connector assembly as claimed in claim 3, wherein The tenon of the plug houing is formed in its laterally opposite sides respectively with evenly spaced second slots, the second slots extend through the tenon and the bottom to receive the second contacts, an outer side of each second slot communicates with outside to expose the second spring contact portion to the exterior of the tenon.

7. The low profile board-to-board connector assembly as claimed in claim 6, wherein an inner side of the second slot forms an interference groove.

8. The low profile board-to-board connector assembly as claimed in claim 1, wherein the receptacle housing defines a protrusion at each end thereof, the plug housing has a ear extending outwardly from each end thereof, the ear forms a notch for engaging with the protrusion to interconnect the receptacle and the plug.

9. The low profile board-to-board connector assembly as claimed in claim 1, wherein a free end of the first spring contact portion is inclined outwardly to define a contact end.

10. The low profile board-to-board connector assembly as claimed in claim 1, wherein the second spring contact portion forms a dent at the lower end thereof for latching engagement with a free end of the first spring contact portion.

11. The low profile board-to-board connector assembly as claimed in claim 1, wherein the retention portion of the first contact has barbs on its opposite edges.

12. The low profile board-to-board connector assembly as claimed in claim 1, wherein the locking portion of the second contact has tabs on its opposite edges.

* * * * *